US006095443A

United States Patent [19]

Haikkala et al.

[11] Patent Number: 6,095,443

[45] Date of Patent: Aug. 1, 2000

[54] ARRANGEMENT FOR FEEDING WOOD IN A PULP GRINDER

[75] Inventors: Pekka Haikkala, Siivikkala; Jouko Hautala, Tampere; Heikki Liimatainen, Tampere; Kari Pärssinen, Tampere; Simo Setälä , Tampere; Olli Tuovinen, Tampere, all of Finland

[73] Assignee: Valmet Corporation, Helsinki, Finland

[21] Appl. No.: 09/319,289

[22] PCT Filed: Dec. 12, 1997

[86] PCT No.: PCT/FI97/00782

§ 371 Date: Jul. 20, 1999

§ 102(e) Date: Jul. 20, 1999

[87] PCT Pub. No.: WO98/27267

PCT Pub. Date: Jun. 25, 1998

[30] Foreign Application Priority Data

Dec. 16, 1996 [FI] Finland ..... 965047

[51] Int. Cl.[7] ..... B02C 19/12

[52] U.S. Cl. ..... 241/186.1; 241/280; 241/281; 241/282

[58] Field of Search ..... 241/280, 281, 241/282, 185.5, 186.1

[56] References Cited

U.S. PATENT DOCUMENTS

| | | | |
|---|---|---|---|
| 1,359,016 | 11/1920 | Baker | 241/282 |
| 1,626,015 | 4/1927 | Ullgren | 241/282 |
| 3,528,618 | 9/1970 | Ullner | 241/282 |
| 4,840,317 | 6/1989 | Henrich | 241/282 |

FOREIGN PATENT DOCUMENTS

| | | |
|---|---|---|
| 0 266 582 A1 | 5/1988 | European Pat. Off. . |
| 11486 | 12/1925 | Finland . |
| 83792 | 5/1991 | Finland . |
| 28 12 299 A1 | 9/1979 | Germany . |
| 341 865 | 1/1972 | Sweden . |

*Primary Examiner*—John M. Husar
*Attorney, Agent, or Firm*—Alston & Bird LLP

[57] ABSTRACT

An arrangement in a pulp grinder comprising a grindstone, a feed chute extending to the grindstone, a piston moving in the feed chute, an auxiliary piston and closing members. In the arrangement, there are recesses on the front of the piston and apertures in the auxiliary piston so that the closing members can be pushed from both sides of the feed chute through the auxiliary piston to the recesses of the piston so that they settle behind the wood pressed by the piston.

6 Claims, 6 Drawing Sheets

ARRANGEMENT FOR FEEDING WOOD IN A PULP GRINDER

FIELD OF THE INVENTION

The invention relates to an arrangement for feeding wood in a pulp grinder comprising a grindstone, a feed chute extending to the grindstone, a piston moving in the feed chute to press the wood against the grindstone, and a closing member to prevent the wood from moving away from the grindstone when the piston is moved away from the grindstone so as to allow the feed of a new batch of wood.

BACKGROUND OF THE INVENTION

When wood is ground to produce fibres, the grinders typically used are grinders in which the blocks of wood are pressed against the surface of a rotary grindstone, simultaneously spraying water there to produce a pulp suspension. The most generally, the wood supply is implemented in pulp grinders on a discontinuous basis: one batch of wood at a time is fed into a feed chute, after which the wood in the feed chute is pressed by a cylinder and a piston against the grindstone. In order that the output would be as great as possible, two feed chutes, with cylinders, are usually arranged on the opposite side, of the grindstone. Consequently, when a feed chute is being filled, the grindstone is subjected to less load than when both the feed chutes are in the grinding step, and this causes both uneven loading and variation in the quality of the ground pulp. Further, the drawback of the discontinuous supply is that the output is smaller when the wood is fed in batches than when continuous grinding is used. Another problem in the discontinuous grinding is that the blocks of wood fed during the compression press more firmly against each other, which also results in variation between the production rates at the beginning and at the end of the grinding. Consequently, for example the freeness of the ground pulp is higher at the beginning of the compression, dropping toward the end of the furnace, even if the feed rate at the piston of the cylinder is adjusted to remain constant. For the same reason, the motor is loaded unevenly.

Previously known are also continuous grinders in which the continuous wood supply is based on moving feed chains on both sides of a feed chute and on the weight of the wood in the feed chute. Such a grinder is known, for example, from German Offenlegungsschrift 28,12,299. The drawback of the solution is that to provide the continuous wood supply and sufficient compression, the chains must be rather long, which in practice means that the feed chute must be up to 6–8 metres high. The contact surface between the chains and the blocks of wood that are being fed is thus sufficiently large, and the weight of the pile of wood simultaneously helps to press the wood against the feed chains for compression. Because of this, only an essentially upright feed chute can be used in the grinding process, which notably restricts the amount of wood that can be ground simultaneously. As a result, the capacity of the grinder is naturally smaller than in solutions where wood fed from two or more feed chutes can be ground simultaneously. Another problem in the high feed chute is that the blocks of wood may settle obliquely, which affects the grindstone and because of which the grinder must be sharpened unduly often in order to correct the obliqueness. Since the pressing force of the chains does not divide evenly between the blocks of wood in the feed chute, but in practice the blocks of wood that are the closest to the chains are fed at a higher feed rate than those in the middle of the feed chute, this affects the quality and may also cause the above obliqueness.

European Patent 266,582 teaches a solution comprising one or two auxiliary pistons in addition to the actual pressing piston, the auxiliary pistons being pushed by separate feed cylinders toward the grindstone when the actual pressing piston is moved to the starting position of its stroke to allow the feed of a new batch of wood. In this embodiment, a separate closing trap is to be pushed in between the actual piston to prevent the wood from moving backward with the piston. The closing trap is to be pushed between the piston and the wood as the piston presses the wood, whereby the closing trap would have to be pushed to its place under great compression. In practice, this is not possible since the frictional forces caused by the pressing force are so great that the solution is impossible to implement. Correspondingly, if the piston were pulled back first, the operation of the trap and the grinding process would be essentially impaired.

SUMMARY OF THE INVENTION

The object of the present invention is to provide an arrangement by which essentially continuous grinding can be provided under essentially constant grinding conditions, even though the wood is fed into the grinder in batches. The arrangement of the invention is characterized in that the piston comprises at least one recess into which the closing member can be pushed so that when the closing-member is in the feed chute, the feed chute is closed crosswise of the wood to be ground so that the backward movement of the wood is essentially prevented when the piston moves backward. The essential idea of the invention is that the invention comprises closing members on one or both sides of the feed chute, and that as the piston presses the wood the closing members can be pushed into the recesses of the pressing piston to close the feed chute, whereby the wood will not be able to move backward from the compression with the piston as the piston moves to the starting position of its stroke to allow the feed of a new batch of wood. It is the essential idea of a preferred embodiment of the invention that the invention comprises at least one auxiliary piston and that the closing members can be pushed through each auxiliary piston and that each auxiliary piston can move in relation to the closing members, the auxiliary members having such apertures that the wood between the closing members and the grindstone can be pressed by the auxiliary pistons so that the grinding continues essentially unchanged even when a new batch of wood is being fed in front of the piston.

BRIEF DESCRIPTION OF THE DRAWINGS

The invention will now be described in greater detail with reference to the attached drawing wherein.

DETAILED DESCRIPTION OF PREFERRED EMBODIMENTS

Figure 1A:
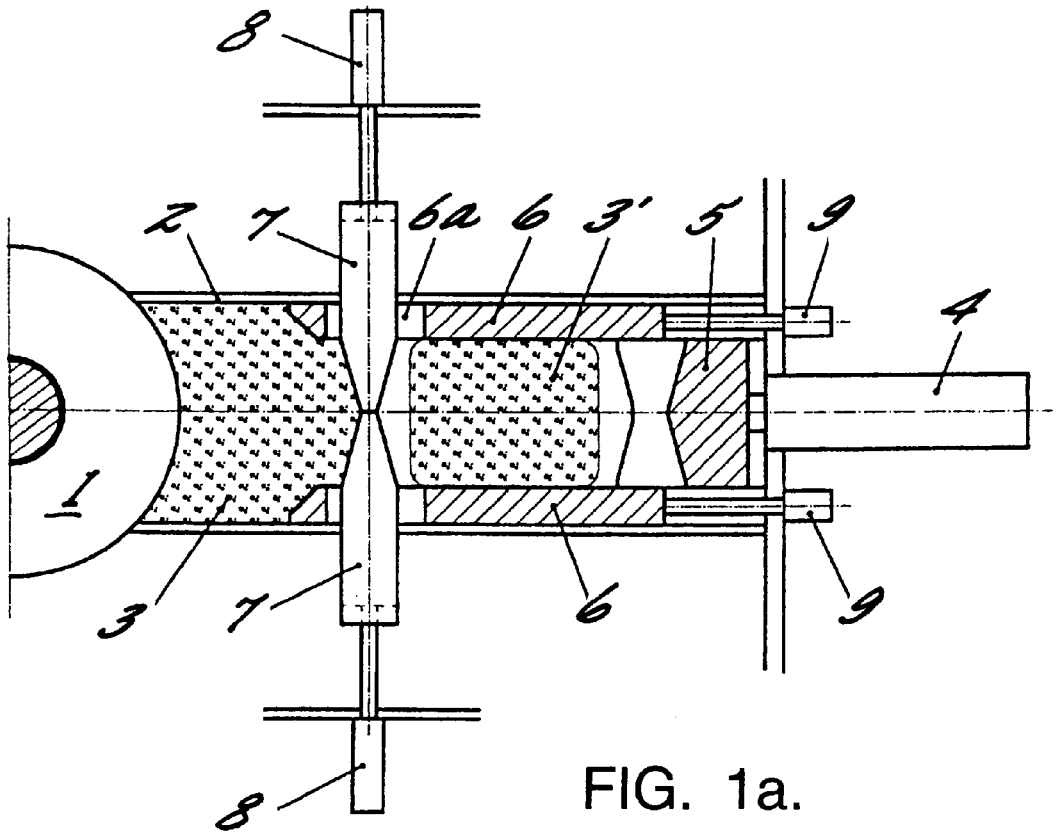
FIGS. 1*a* to 1*d* show a schematic sectional side view of an embodiment of the arrangement according to the invention.

FIG. 1*a* shows a schematic view of a grinder comprising a grindstone 1 and a feed chute 2 extending to it. In the feed chute 2 there are blocks of wood 3, which are pressed by a piston 5 connected to a feed cylinder 4 against the grindstone 1. Further, FIGS. l*a* to 1*d* show two auxiliary pistons 6, which are arranged between the piston 5 and the feed chute 2 on both sides of the piston. The grinder also comprises closing members 7 on both sides of the feed chute 2. The closing members can be moved by closing cylinders 8 crosswise of the feed chute 2 so that when they are in the 'in' position, they essentially reach each other, preventing the wood 3 in the feed chute 2 from moving away from the grindstone 1. The piston 5 comprises one or more recesses for receiving the closing members 7, the closing members 7 pushing between the wood 3 and the piston 5 into the recesses. Further, the auxiliary pistons 6 comprise apertures 6*a*, through which the closing members 7 extend and can push into the movement range of the piston 5. The length of the apertures 6*a* is such that the auxiliary pistons 6 can move a desired distance in their longitudinal direction in relation to the feed chute 2. The auxiliary pistons 6 can thus push the wood by the effect of auxiliary cylinders 9 toward the grindstone 1.

Figure 1B:
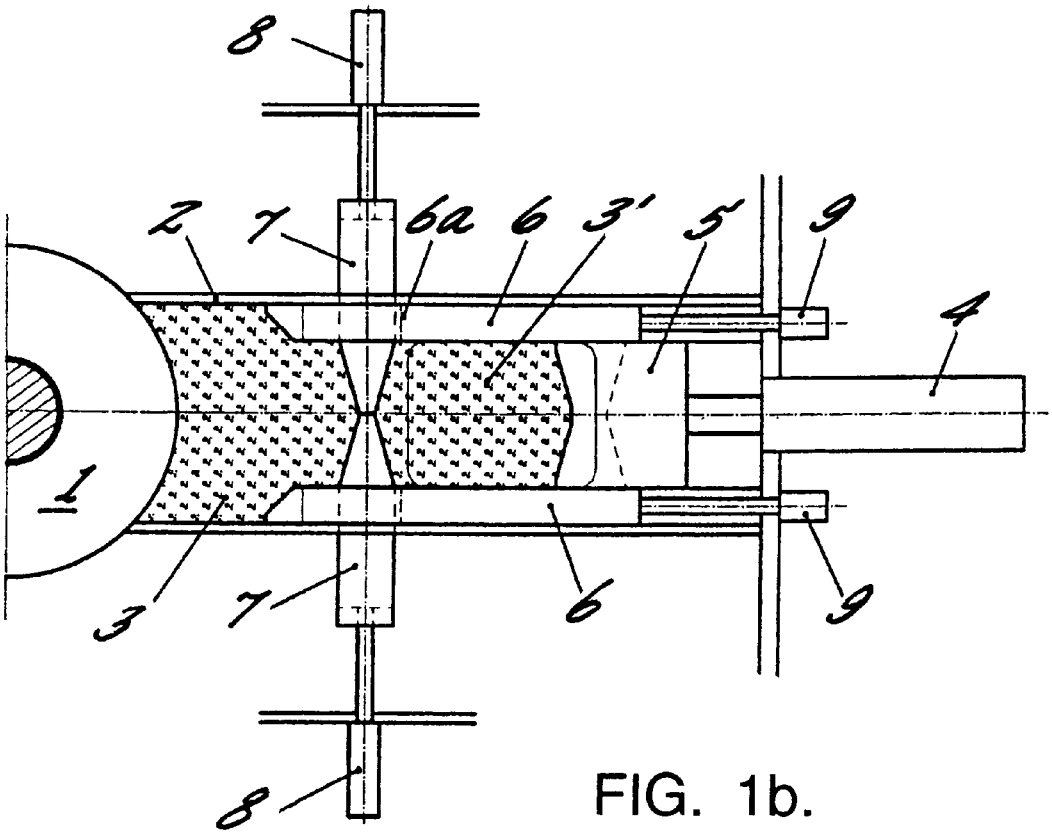
Figure 1C:
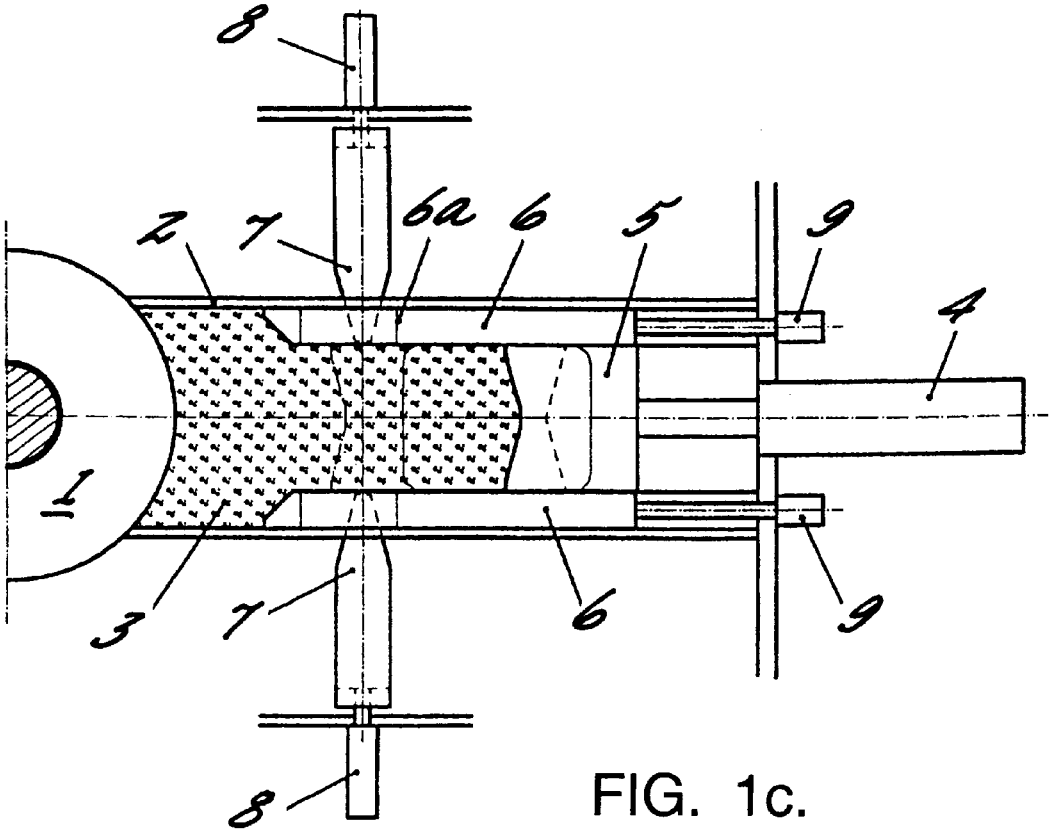
Figure 1D:
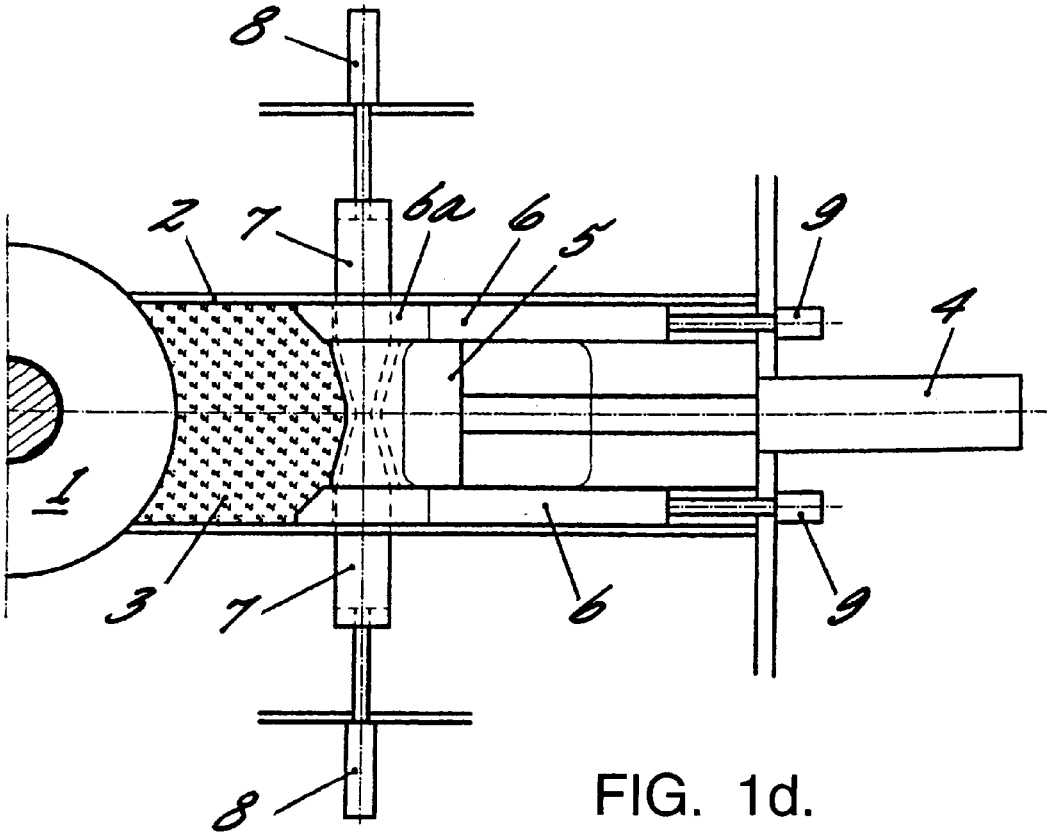
Figure 2A:
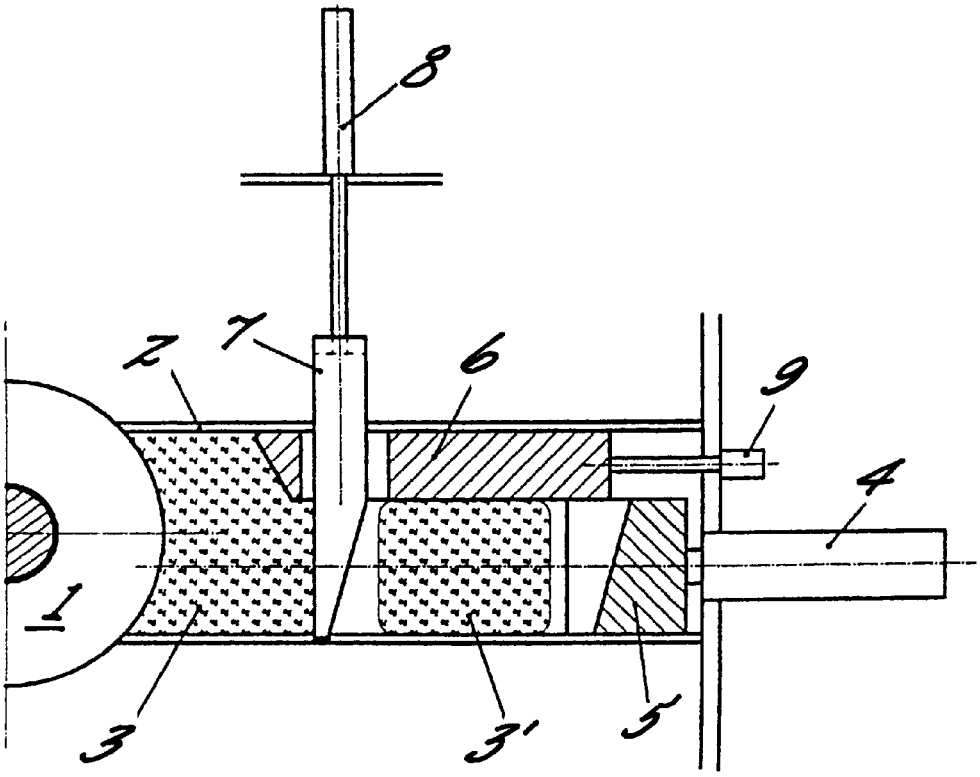
FIGS. 2*a* to 2*d* show a schematic sectional side view of another embodiment of the arrangement according to the invention.
Figure 2B:
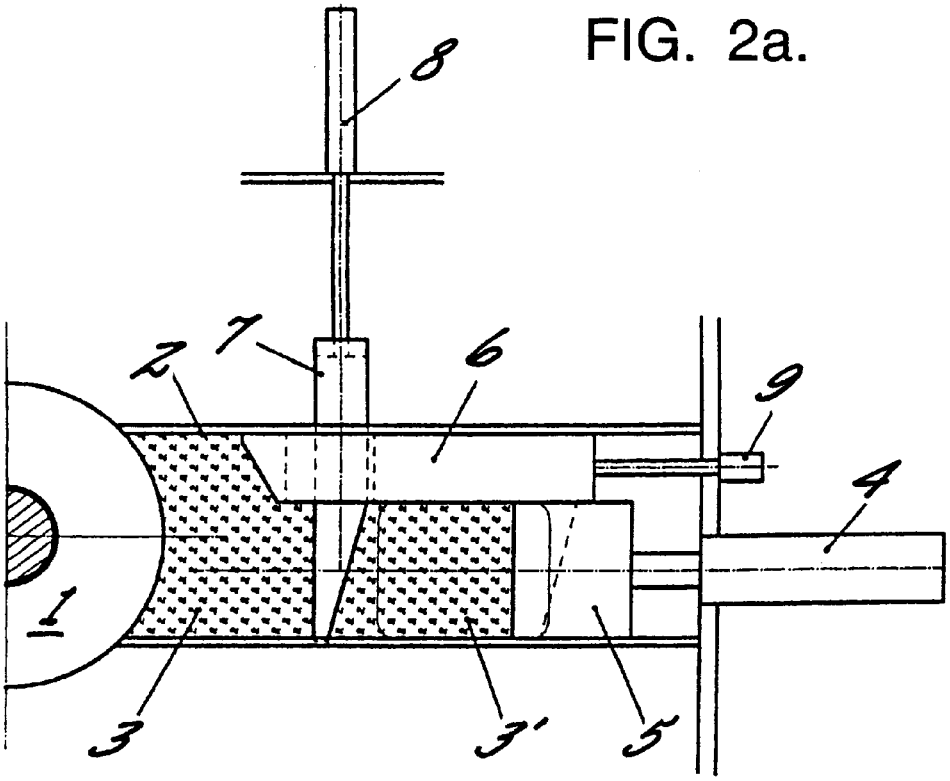
Figure 2C:
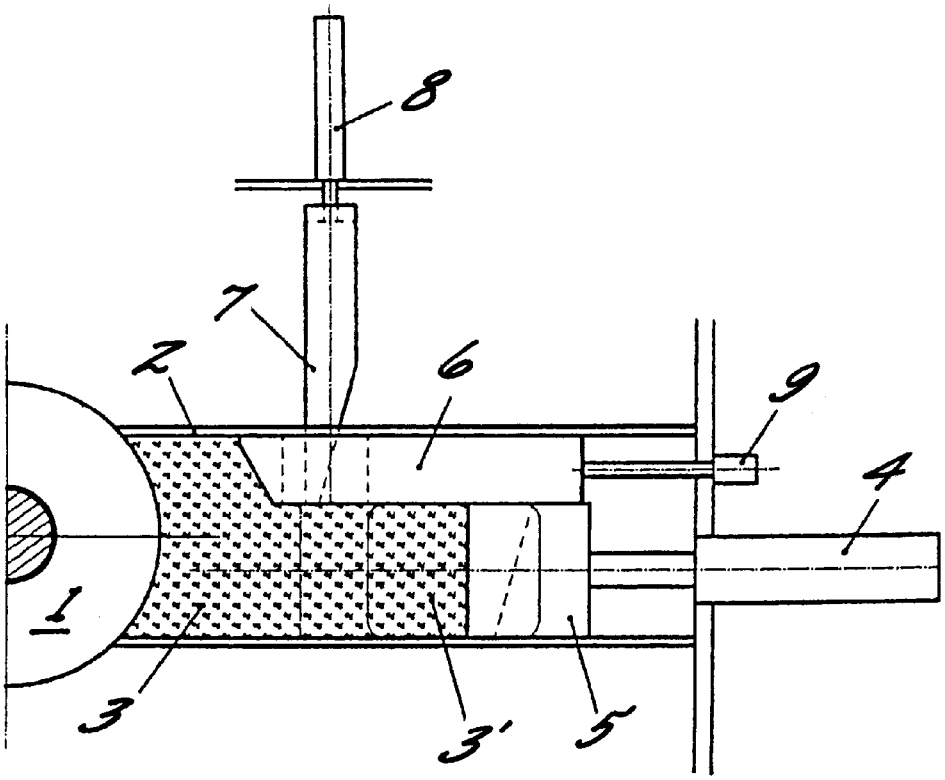
Figure 2D:
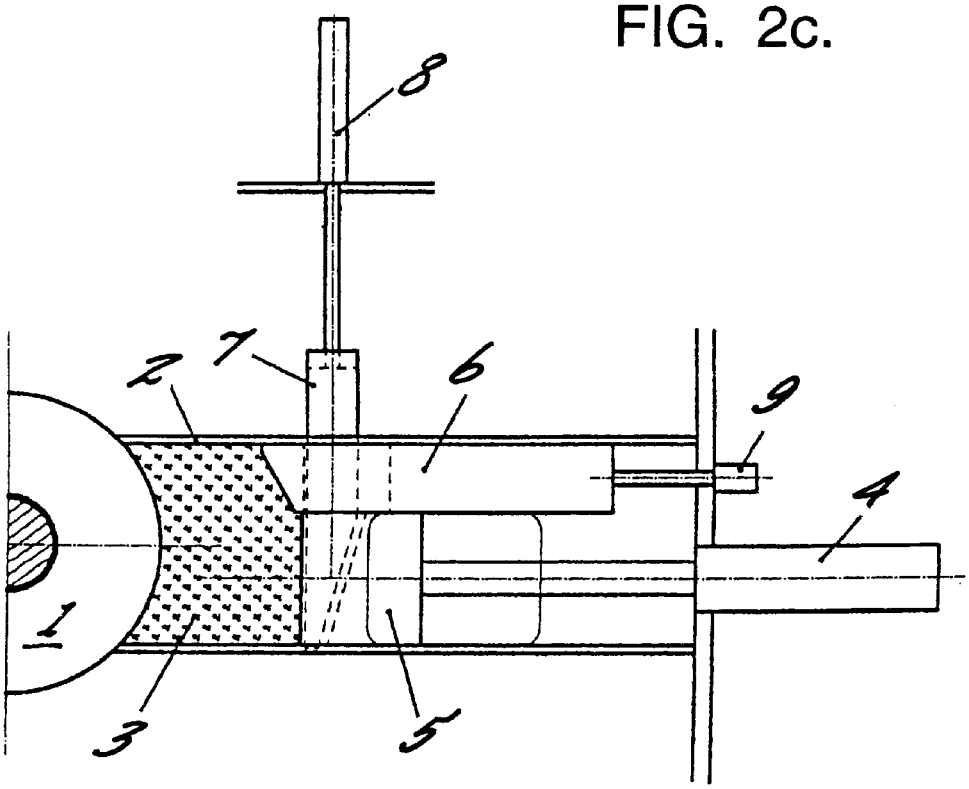

FIG. 1*a* shows a situation where the wood in the feed chute, tightly compressed by the piston 5, is ground by the rotating grindstone so that fibre is detached. The closing members 7 are inserted in the feed chute 2, thereby preventing the wood 3 from moving away from the grindstone 1. The auxiliary pistons 6 are moved toward the grindstone 1 by the auxiliary cylinders 9, whereby the auxiliary pistons, upon moving, compress the wood between the closing means 7 and the grindstone in the feed chute 2 and thereby effect essentially continuous compression between the wood 3 and the grindstone 1. Simultaneously, the piston 5 is in its extreme position, the furthest away from the grindstone 1, and a new batch of wood 3' has been fed in front of it, for example, in the manner described in Finnish Patent 69,653 or in some other solution known per se. FIG. 1*b*, in turn, shows a situation where the piston 5 has been pushed toward the grindstone 1 by the feed cylinder 4 so that the batch of wood 3' pressing against the closing members 7 is being compressed. When the batch of wood 3' has compressed to a sufficient degree, the closing members 7 are slowly pulled away from the feed chute 2 by the closing cylinders 8, whereas the piston 5 and the auxiliary pistons 6 continue to move toward the grindstone 1. When the batch of wood ' has been compressed sufficiently tightly, the wood 3 is continued to be pressed by the piston 5, but the auxiliary pistons 6 are slowly pulled backward, i.e. away from the grindstone, by the auxiliary cylinders 9, until the situation illustrated by FIG. 1*d* is achieved. In FIG. 1*d*, the auxiliary pistons are the furthest away from the grindstone 1, and the piston 5 is the closest to the grindstone 1. The closing members 7 are then pushed into the feed chute by the closing cylinders 8 so as to prevent the backward movement of the wood, and the cycle of operation will restart in the manner described in connection with FIG. 1*a*. As shown in the figure, the closing members 7 are symmetrical in relation to the feed chute 2 and thereby also the piston 5, and they narrow toward the centre of the feed chute, whereby they are easy to pull away from between the blocks of wood. Further, the pushing surface of the piston 5 is naturally such that it essentially corresponds with the shape of the heads of the closing members 7. Alternatively, that surface of the closing members which is close to the grindstone 1 can be straight, and those surfaces of the piston 5 which come into contact with the wood can also be straight.

The advantage of the arrangement is that the compression of the wood pressed against the grindstone 1 and the grinding conditions can be maintained essentially constant, whereby the motor power of the grinder can be set to be essentially constant in a desired manner. The grinding conditions are maintained essentially unchanged, and the quality of the fibre obtained and the output of the grinder can be maintained constant in a desired manner. The feed chute of the grinder can thus be shorter and the dimensions of the grinder can thereby be smaller than in the previously known continues grinders, and one or more feed chutes with the necessary components can be arranged around one and the same grindstone to maximize the capacity of the grinder.

FIGS. 2*a* to 2*d* show an embodiment that is otherwise similar to that of FIG. 1 except that only one auxiliary piston 6 and one closing member 7 are used therein.

Figure 3A:
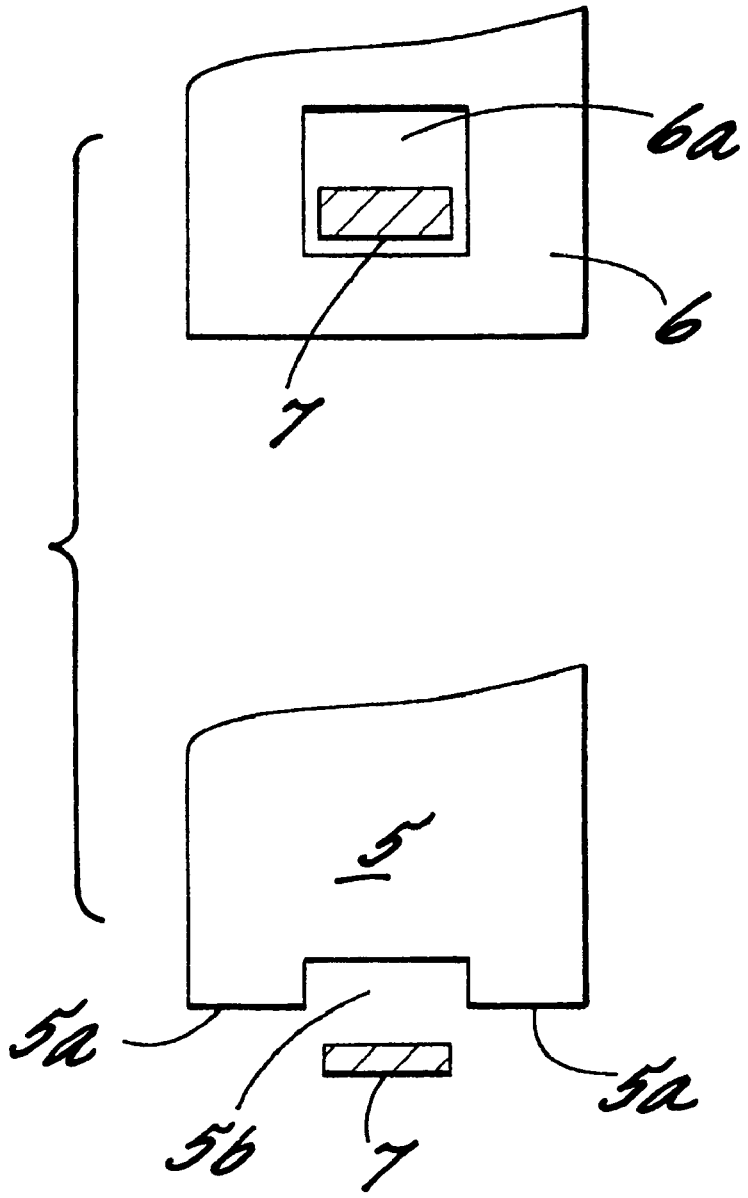
FIGS. 3*a* and 3*b* show a schematic view of alternative embodiments of the closing members and the shape of the piston and the auxiliary piston in these embodiments.
Figure 3B:
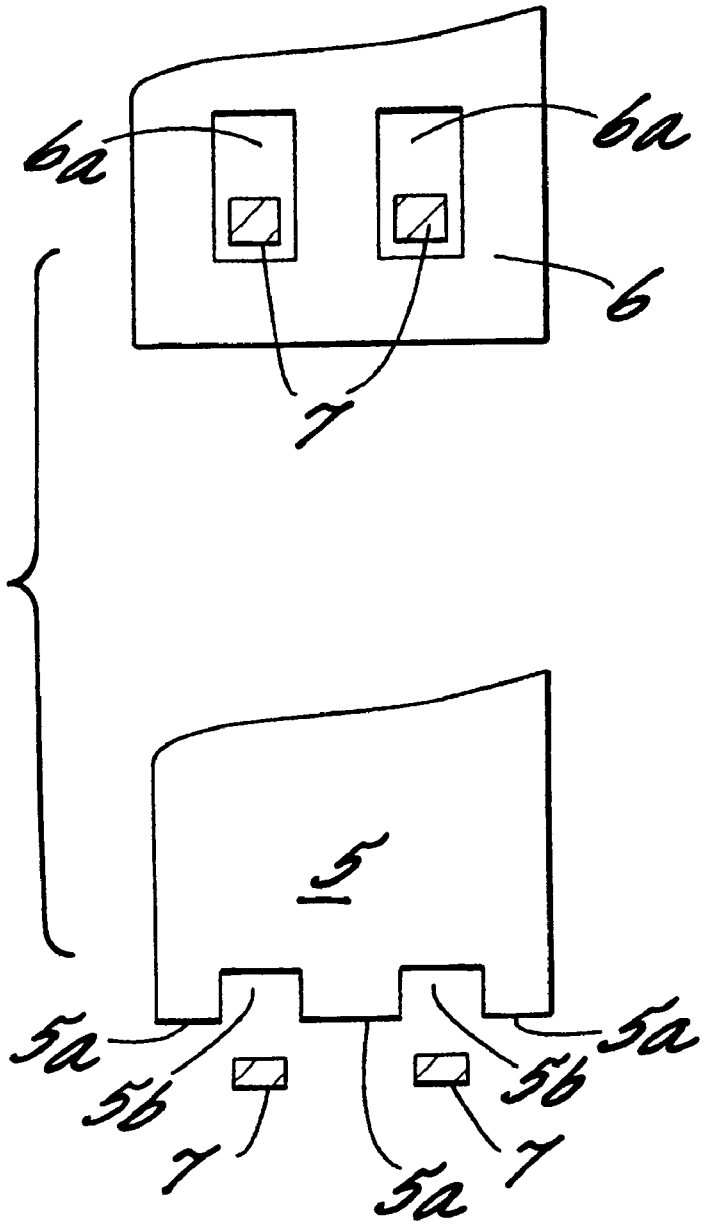

FIGS. 3*a* and 3*b*, in turn, show the cross-sections of two different embodiments of the closing members and the corresponding shapes of the piston 5 and the auxiliary pistons 6, seen from the same direction. In FIG. 3*a* the closing member 7 is a single continuous sheet-like component, whereby the piston 5 comprises, at the edges, two press surfaces 5*a* pressing the wood and between the surfaces a recess 5*b* essentially corresponding in shape with the closing member 7. The auxiliary piston 6 comprises an elongated aperture 6*a* in the middle, the aperture being wider than the closing member 7 and its length in the longitudinal direction of the auxiliary piston 6 being such that the auxiliary piston can move a sufficient distance. FIG. 3*b*, in turn, illustrates an embodiment comprising either two separate closing members arranged in parallel or one continuous fork-like unit comprising two closing members. In this embodiment, the piston 5 comprises three press surfaces 5*a* pressing the wood and two recesses 5*b* between them, the shape of the recesses being such that the parallel closing members can push into the piston 5, between the piston and the wood. The auxiliary piston 6 comprises two apertures 6*a*, the distance between the apertures and the width of the apertures being such that the closing members can push through the apertures. The length of the apertures 6*a* is such that the auxiliary piston 6 can move a desired distance in relation to the closing members.

As shown in FIGS. 1*a* to 1*d* and 2*a* to 2*a*, the closing members are arranged on those sides of the feed chute 2 which are essentially parallel to the axle of the grindstone 1. Both the closing members 7 and those surfaces of the piston 5 which come into contact with the wood 3 are therefore crosswise of the axle of the grindstone 1, so that when the wood is parallel to the axle of the grindstone, as usual, the closing members 7 and those surfaces of the piston 5 which come into contact with the wood are also crosswise of the wood.

The above description and the drawings present the invention only by way of example, without limiting it in any way. There may be one or more closing members on both sides of the feed chute. Also, the closing members in the crosswise direction of the feed chute can either be continuous or consist of several parts, and the apertures of the auxiliary pistons and the recesses of the piston must be designed accordingly. The invention is not limited to a pulp grinder of a certain type. It can thus be used in both non-pressure grinders and pressure grinders, the other necessary operations and apparatuses being implemented conventionally in a previously known manner so that they are suited to the solutions in question.

What is claimed is:

1. An arrangement for feeding wood in a pulp grinder of the type having a grindstone, a feed chute extending to the grindstone, and a piston that is slidable within the feed chute and has an end face configured to press the wood against the grindstone said arrangement comprising:

at least one closing member that is movable into the feed chute crosswise of the wood to prevent the wood from moving away from the grindstone when the piston is moved away from the grindstone so as to allow a new batch of wood to be fed into the feed chute between the face of the piston and the closing member, and the end face of the piston defining at least one recess into which the at least one closing member can be pushed while the end face of the piston is pressing the wood against the grindstone, so that when the at least one closing member is pushed in the feed chute, the feed chute is closed crosswise of the wood to be ground so that backward movement of the wood is essentially prevented when the piston moves backward.

2. The arrangement according to claim 1, further comprising at least one auxiliary piston slidably disposed within the feed chute for pressing the wood against the grindstone, the auxiliary piston defining at least one aperture that extends therethrough in a direction crosswise of the wood so that the at least one closing member can be pushed through the auxiliary piston each aperture of the auxiliary piston having a length in the travel direction of the auxiliary piston that is sized such that when the at least one closing member is pushed through the aperture to close the feed chute, the auxiliary piston can be moved toward the grindstone to press the wood continuously against the grindstone.

3. The arrangement according to claim 2, wherein two closing members are disposed on opposite sides of the feed chute and two auxiliary pistons are slidably disposed within the feed chute on opposite sides of the piston each auxiliary piston defining an aperture such that the closing members can be pushed through the apertures to close the feed chute.

4. The arrangement according to claim 1, comprising a single closing member formed as a continuous closing member, and wherein the piston comprises a single recess extending crosswise of the piston in a travel direction of the closing member.

5. The arrangement according to claim 1, comprising at least two closing members disposed on at least one side of the feed chute, the closing members being spaced apart in a crosswise direction of the piston and the piston defining an equal number of recesses as there are closing members in the crosswise direction of the piston.

6. A pulp grinder for grinding wood to make wood pulp, comprising:

a grindstone;

a feed chute extending to the grindstone;

a piston that is slidably disposed within the feed chute and has an end face configured to press the wood against the grindstone;

at least one closing member that is movable into the feed chute crosswise of the wood to prevent the wood from moving away from the grindstone when the piston is moved away from the grindstone so as to allow a new batch of wood to be fed into the feed chute between the end face of the piston and the closing member; and the end face of the piston defining at least one recess into which the at least one closing member can be pushed while the end face of the piston is pressing the wood against the grindstone, so that when the at least one closing member is pushed into the feed chute, the feed chute is closed crosswise of the wood so that backward movement of the wood is essentially prevented when the piston moves backward.

* * * * *

UNITED STATES PATENT AND TRADEMARK OFFICE
CERTIFICATE OF CORRECTION

PATENT NO. : 6,095,443

DATED : August 1, 2000

INVENTOR(S) : Haikkala et al.

It is certified that error appears in the above-identified patent and that said Letters Patent is hereby corrected as shown below:

Column 5, line 8, before "face" insert --end--; line 23, after "piston", first occurrence, insert a comma (,); line 32, after "piston" insert a comma (,).

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*